US005586906A

United States Patent [19]

Staros et al.

[11] Patent Number: 5,586,906

[45] Date of Patent: Dec. 24, 1996

[54] ELECTRICAL CONNECTOR HAVING AN IMPROVED GRIP MEMBER

[75] Inventors: Theodore Staros, Margate; Alan Flum, Boca Raton, both of Fla.

[73] Assignees: Sony Corporation, Tokyo, Japan; Sony Electronics Inc., Park Ridge, N.J.

[21] Appl. No.: 282,188

[22] Filed: Jul. 28, 1994

[51] Int. Cl.[6] ..... H01R 13/00

[52] U.S. Cl. ..... 439/483; 439/320; 439/484

[58] Field of Search ..... 439/476.1, 483, 439/484, 314, 320

[56] References Cited

U.S. PATENT DOCUMENTS

| | | | |
|---|---|---|---|
| 1,618,723 | 2/1927 | Pearson | 439/483 |
| 3,654,589 | 4/1972 | Distefano et al. | 439/483 |
| 4,310,208 | 1/1982 | Webster et al. | 439/483 X |
| 4,657,331 | 4/1987 | Coldren . | |
| 4,679,880 | 7/1987 | Pitsch . | |
| 4,990,102 | 2/1991 | Myers . | |
| 5,234,358 | 8/1993 | Polgar . | |
| 5,277,617 | 1/1994 | Shasteen . | |

FOREIGN PATENT DOCUMENTS

| | | | |
|---|---|---|---|
| 2331892 | 6/1977 | France | 439/314 |

OTHER PUBLICATIONS

Except from Switchcraft Engineering Design Guide, Switchcraft Inc., 1994, p. 11.

*Primary Examiner*—Khiem Nguyen

*Attorney, Agent, or Firm*—Charles M. Fish, Esq.; Robert P. Biddle, Esq.; Jerry A. Miller

[57] ABSTRACT

An electrical connector having a planar gripping member which allows for improved manual gripping of the connector to facilitate easy connection/disconnection of the electrical connector from an interface point.

10 Claims, 12 Drawing Sheets

ELECTRICAL CONNECTOR HAVING AN IMPROVED GRIP MEMBER

BACKGROUND

1. Field of the Invention

This invention relates generally to the field of electrical connectors. More particularly, The present invention is directed to an electrical connector having a grip member which provides for improved gripping and easy manual manipulation thereof.

2. Background of the Invention

Electrical connectors are commonly used to interconnect electrical conductors, or cables, between various pieces of electronic/electrical equipment such as, for example, audio recording and reproducing equipment. In applications such as audio recording, it is common to electrically interconnect devices such as microphones, mixing control consoles, amplifiers, and equalizers, etc. via electrical cables.

Because of the popularity of portable or mobile equipment, compact electrical equipment and components have increased the need for electrical connectors of smaller sizes to interface the more compact equipment/components with other equipment. One example of a miniature common electrical connector specifically directed to audio applications is the Switchcraft model TA3FL "Tini 'Q–G' Connector". Another example of a common electrical connector is shown in FIG. 1 and FIG. 2.

Although common electrical connectors effectively provide for electrical interfacing of electrical/electronic components, they are typically small and very difficult to manually manipulate. Thus, it is often difficult for the user to effectively grip these connectors to connect/disconnect them from an interface point. This difficulty is compounded when multiple connectors are closely connected adjacent to each other as is commonly found on, for example, an audio patch bay, audio mixing console or the like. Thus connecting and disconnecting of these electrical connectors is often difficult. As a result, users of these types of common miniature electrical connectors often resort to pulling on the electrical cable, or conductor, to which the miniature electrical connector is attached in order to remove or disconnect the connector from an interface point. However, as is well recognized, this practice places substantial detrimental stress on the electrical cable, or conductors, which can increase the risk of premature failure of the cable or destroy, or vary, the resistive, inductive or capacitive characteristics of the cable. In applications, such as audio recording, where accurate electrical characteristics of a conductor are important, such variations are generally regarded as unacceptable.

In view of the above noted shortcomings of common electrical connectors it is an object of the present invention to provide an electrical connector having a grip member which allows for easy manual manipulation. More particularly, the present invention seeks to provide an electrical connector which is easily gripped and thus much easier to connect or disconnect without having to resort to detrimental or destructive practices.

SUMMARY OF THE INVENTION

The present invention provides for an electrical connector having a improved gripping member which includes a housing which is connected to a planar grip member. The housing includes a plurality of electrical contacts each of which are connected to an electrically conductive terminal for interfacing with an electrical conductor. The electrical contacts are held in position within the housing via an insert assembly. The housing has an opening for receiving an electrical conductor and a clamping means for physically interfacing an electrical conductor received through the opening to the housing. The planar grip member includes a pull tab which is generally rectangular in shape and sufficient in size to allow effective manual gripping.

In view of the above identified shortcomings of common electrical connectors it is an object of the present invention to provide for an electrical connector having a grip member which allows for easy manual manipulation. The features of the present invention will become more apparent to those skilled in the art upon consideration of the following description of the invention.

The features of the invention believed to be novel are set forth with particularity in the appended claims. The invention itself however, both as to structure organization and method of operation, will be best understood by reference to the following description in conjunction with the accompanying drawings.

DETAILED DESCRIPTION OF THE INVENTION

Figure 1:
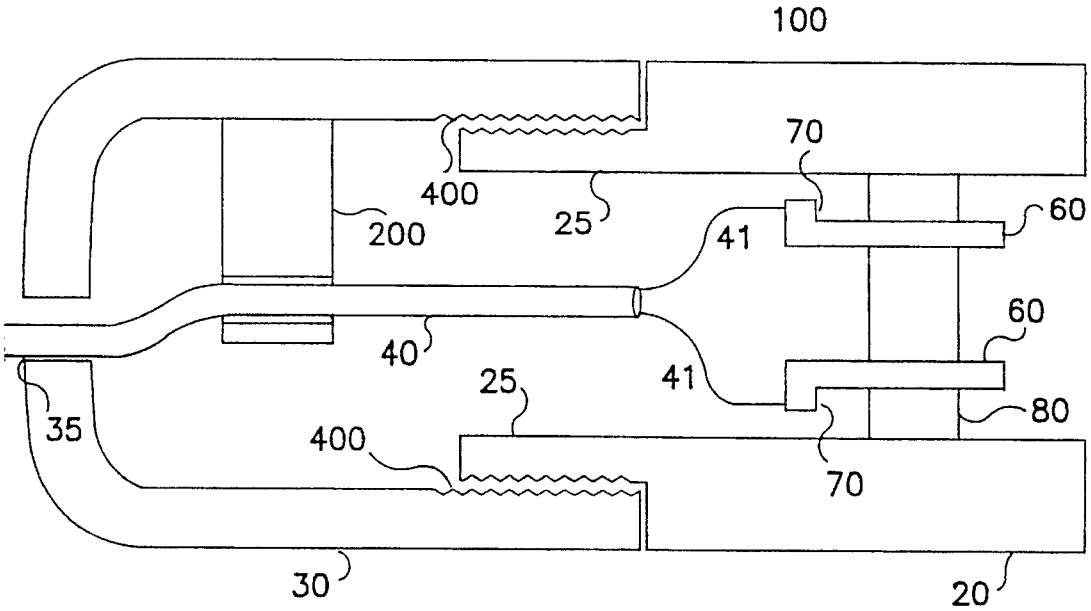
FIG. 1 PRIOR ART
FIG. 1 is an illustration showing a common electrical connector.
Figure 2:
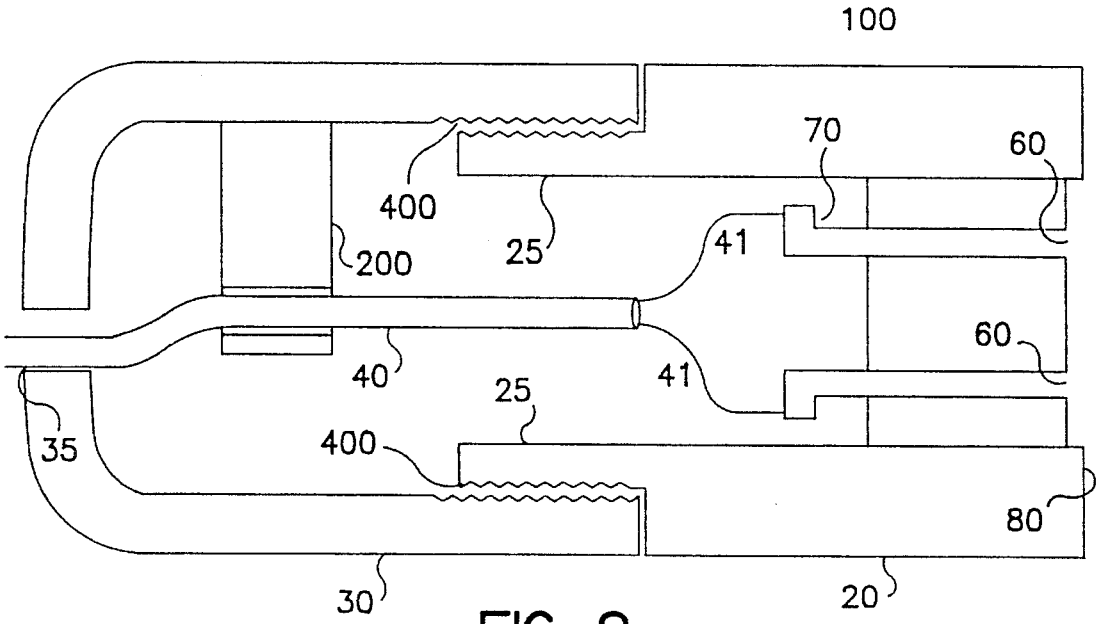
FIG. 2 PRIOR ART
FIG. 2 is an illustration showing another common electrical connector.
Figure 3:
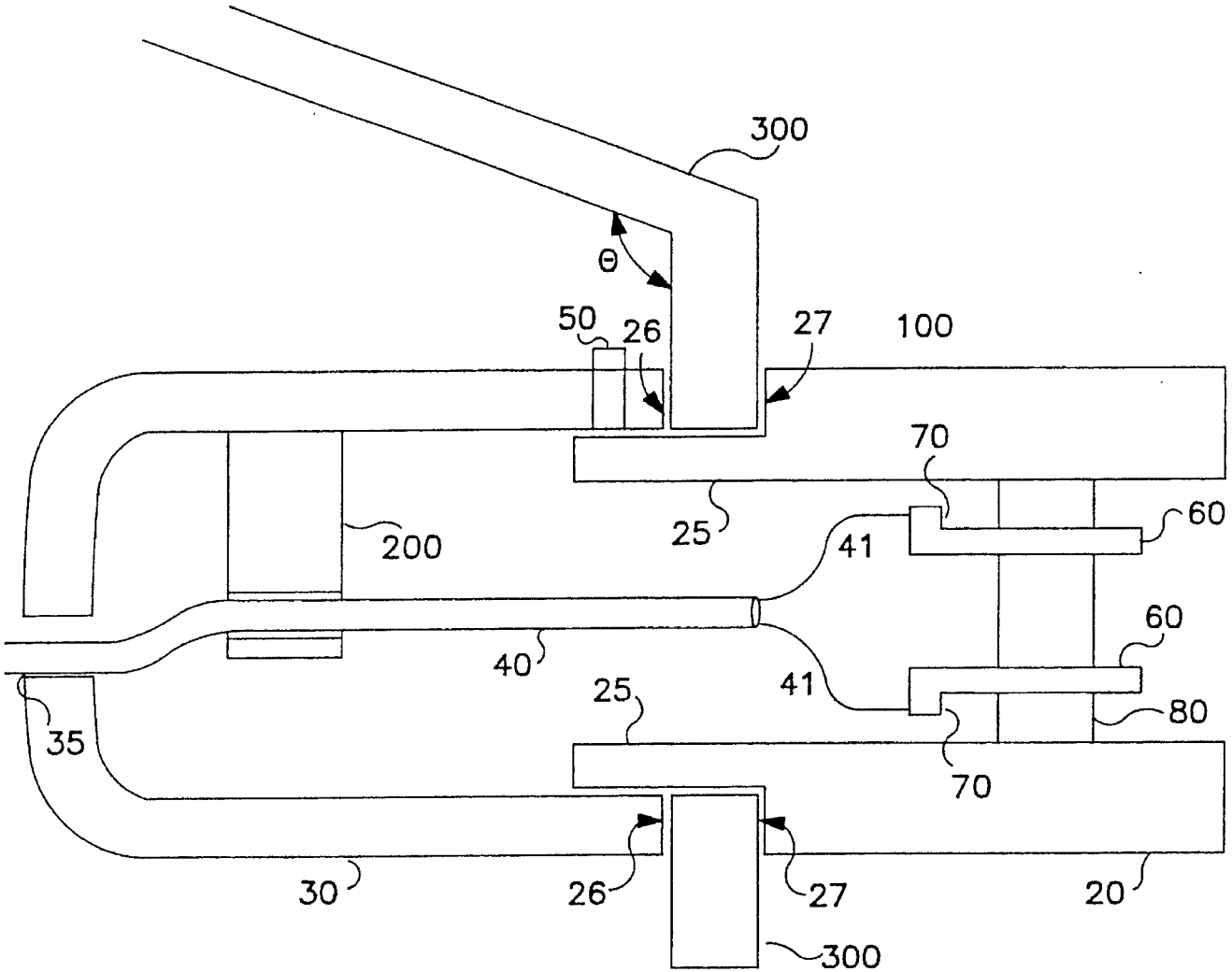
FIG. 3 is an illustration showing one embodiment of the present invention.
Figure 4:
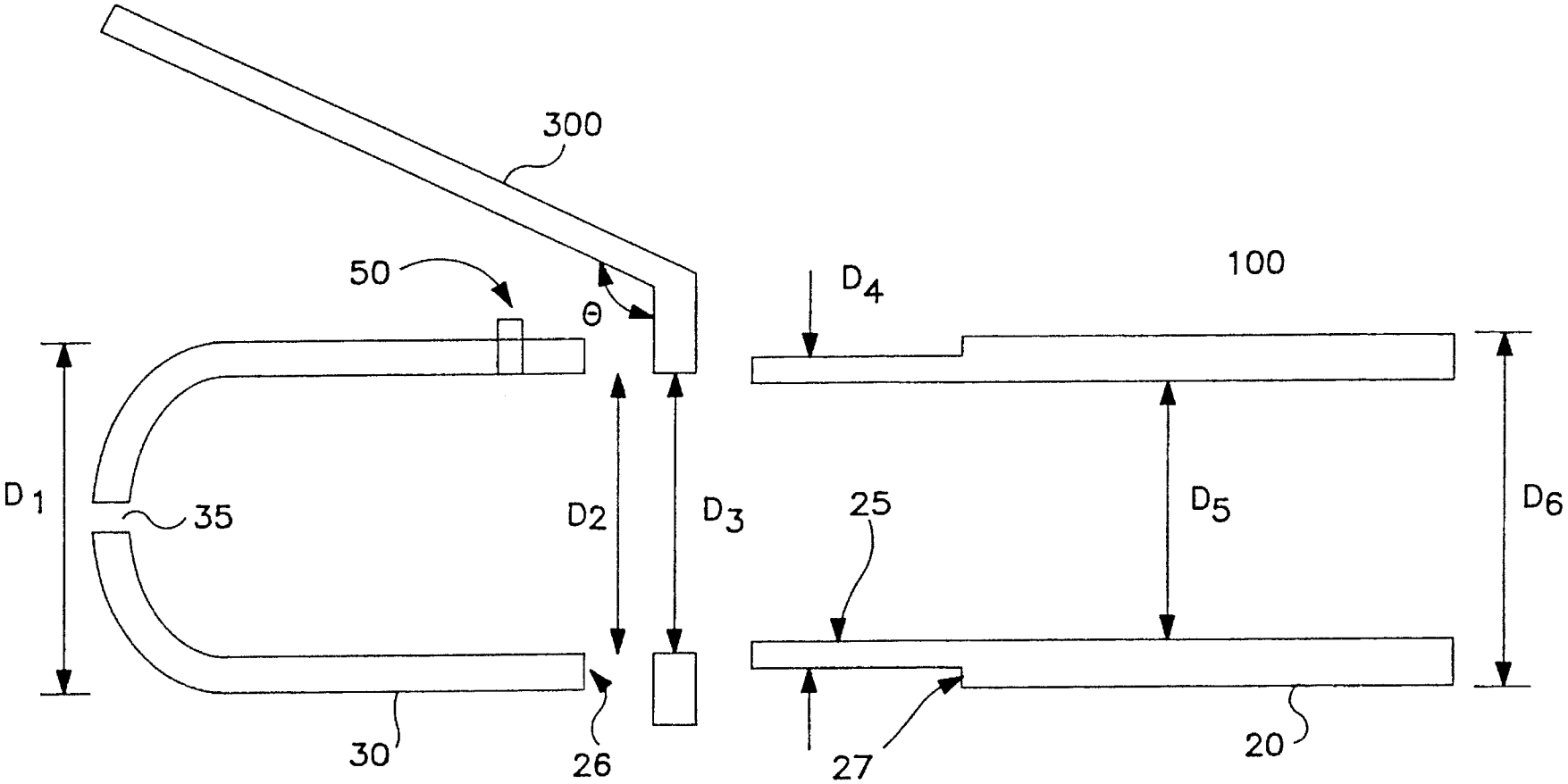
FIG. 4 is a cut-away view showing the relative diameters of various features of the present invention.
Figure 5:
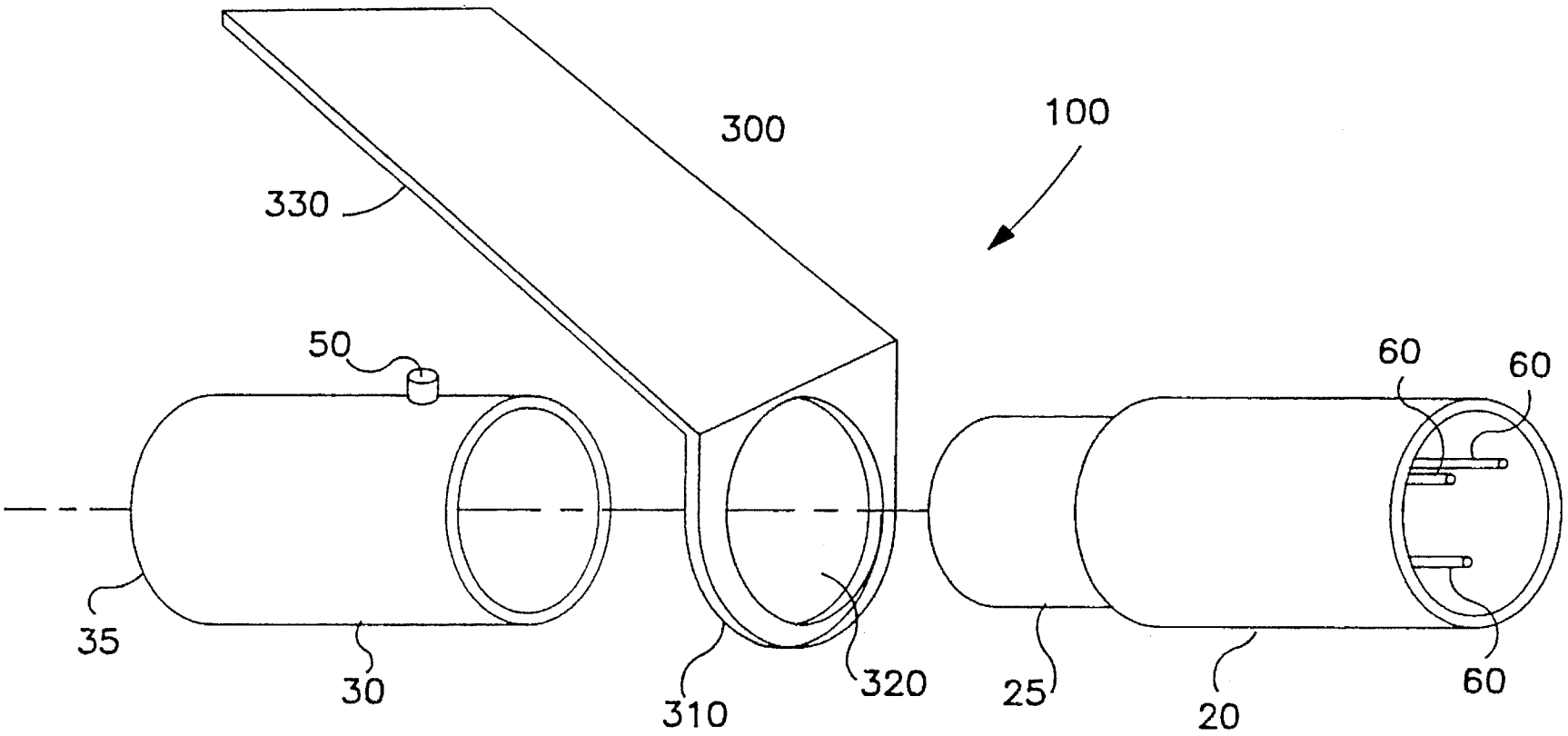
FIG. 5 is an exploded view of one embodiment of the present invention.
Figure 6:
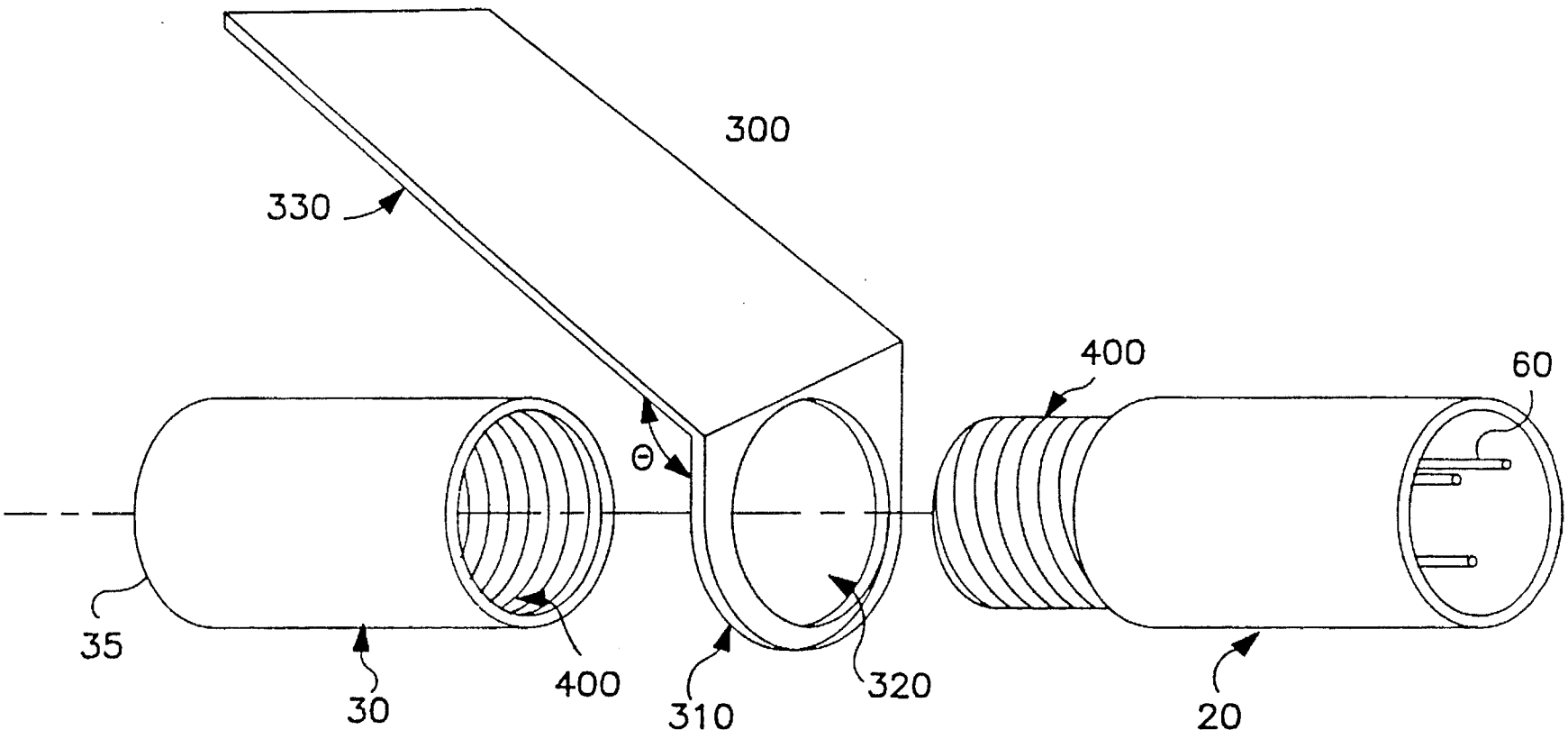
FIG. 6 is an illustration showing a second embodiment of the present invention.
Figure 7:
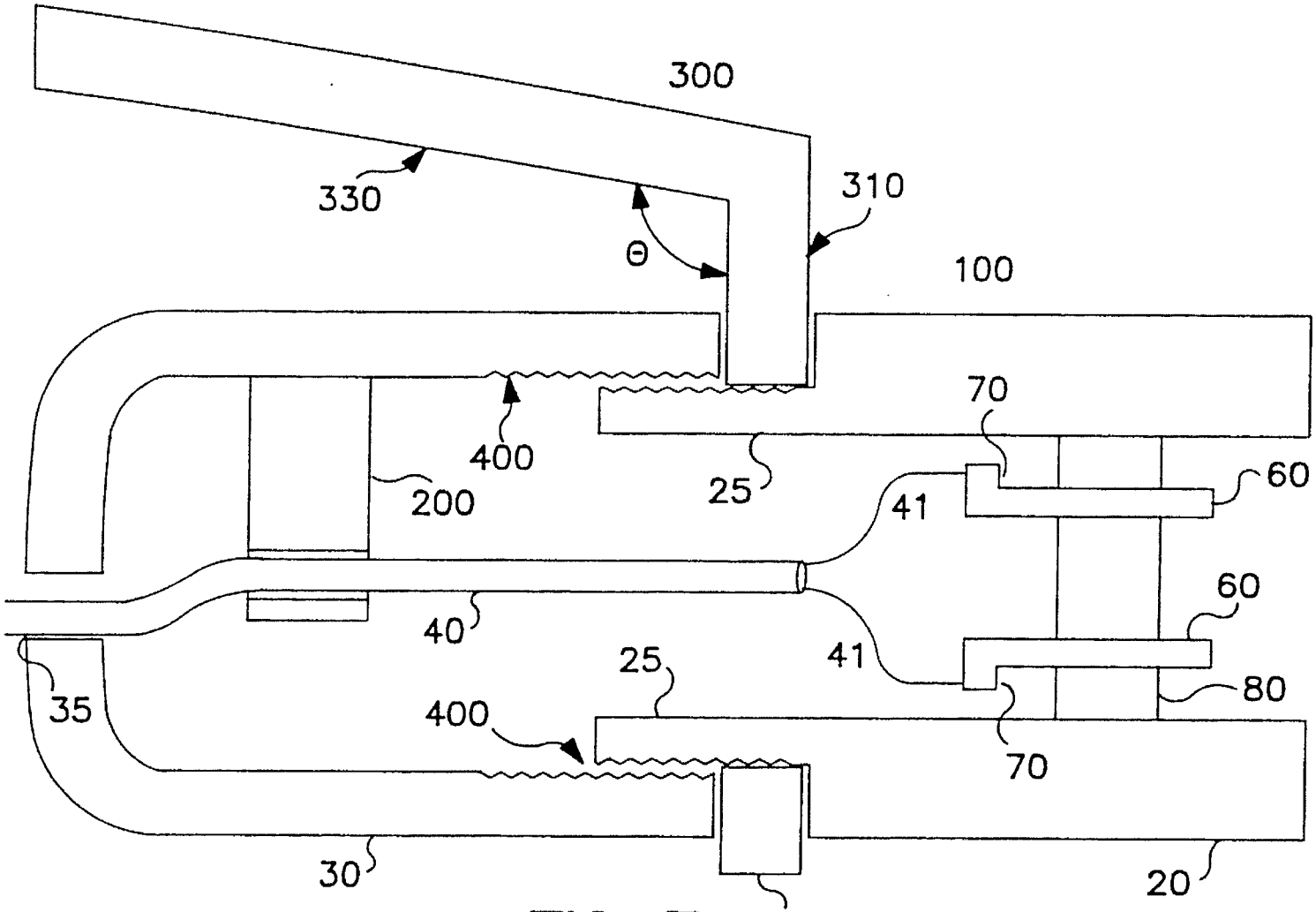
FIG. 7 is a cut-away view showing relative diameters of various features of the present invention.
Figure 8:
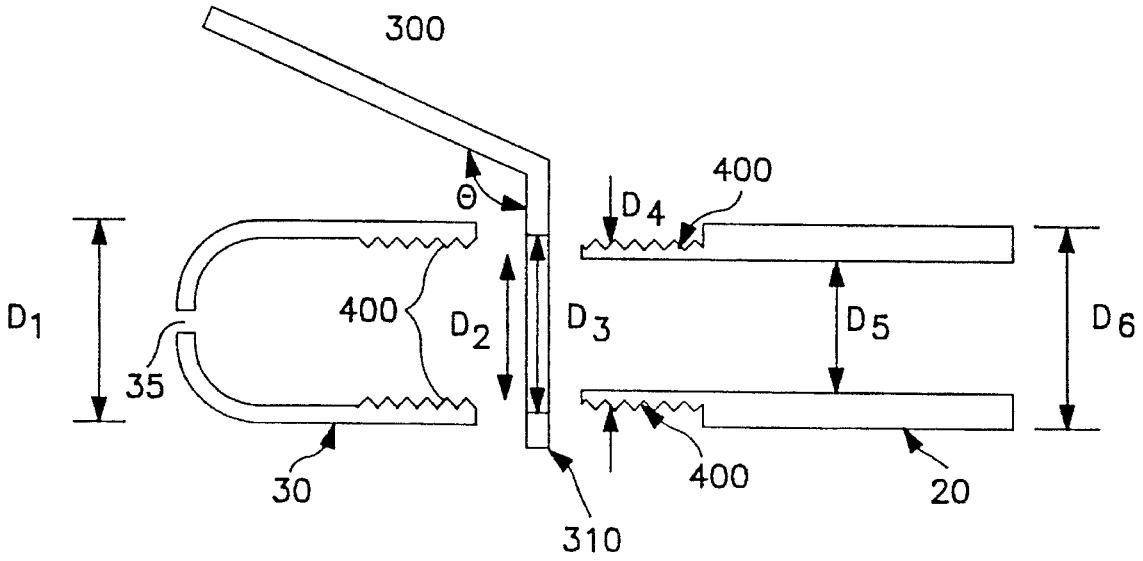
FIG. 8 is an illustration showing another view of the present invention.

With reference to FIGS. 3, 4, and 5, one aspect of the present invention will be described. Electrical connector 100, includes a front housing 20 which is coupled to a back housing 30. Front housing 20 includes a flange 25. Flange 25 has an outer diameter $D_6$. Back housing 30 has an inner diameter $D_2$ which is large enough to receive the outer diameter of flange 25. Front housing 20 includes a plurality of electrical contacts 60. Each of electrical contacts 60 are attached to an electrical terminal 70. Electrical contacts 60 are held in position within front housing 20 via insert assembly 80. Back housing 30 has an opening 35 and a clamp means 200 for physically interfacing a cable 40 received through opening 35 to said back housing 30. A grip member 300 is attached to electrical connector 100. Grip member 300 includes a pull tab 330 which is attached to a planar collar member 310. Planar collar member 310 has an opening 320 formed therein. At least a portion of front housing 20 is received through opening 320 when connected thereto.

In one embodiment of the present invention, electrical connector 100 is substantially cylindrical in shape (See FIGS. 3, 4 and 5). However, FIG. 10 describes an alternate embodiment in which electrical connector 100 is substantially cubic, or block-like, in shape. With reference to FIGS. 3, 4 and 5, it can be seen that connector 100 includes a front housing 20 which is detachably coupled, or mated with, a back housing 30. Front housing 20 is coupled with back housing 30 via friction between set screw 50 and a flange 25 of front housing 20.

Front housing 20 has an inner diameter $D_5$ and an outer diameter $D_6$. Back housing 30 also has an inner diameter $D_2$ and an outer diameter $D_1$. Front housing 20 includes a flange 25 formed on one end thereof which has an outer diameter $D_4$ which is slightly less than the inner diameter $D_2$ of back housing 30, thus allowing flange 25 to be received within back housing 30. Flange 25 extends from front housing 20 in such a way that a lip 27, or surface, is formed between the outer diameter $D_4$ of flange 25 and the outer diameter $D_6$ of front housing 20. The surface of lip 27, is substantially perpendicular to the outer surface of front housing 20. Flange 25 is designed so that it may be received within back housing 30 in a telescoping like fashion to couple front housing 20 therewith. Set screw 50 of back housing 30 contacts flange 25 to physically secure front housing 20 with back housing 30 via friction. With reference to FIG. 6, 7 8, and 9, it can be seen that an alternate embodiment of the present invention provides for the surface of the outer diameter $D_4$ of flange 25 and the surface of the inner diameter $D_2$ of back housing 30 to have mated screw threadings 400 which allow front housing 20 to be securely coupled to back housing 30.

Figure 12:
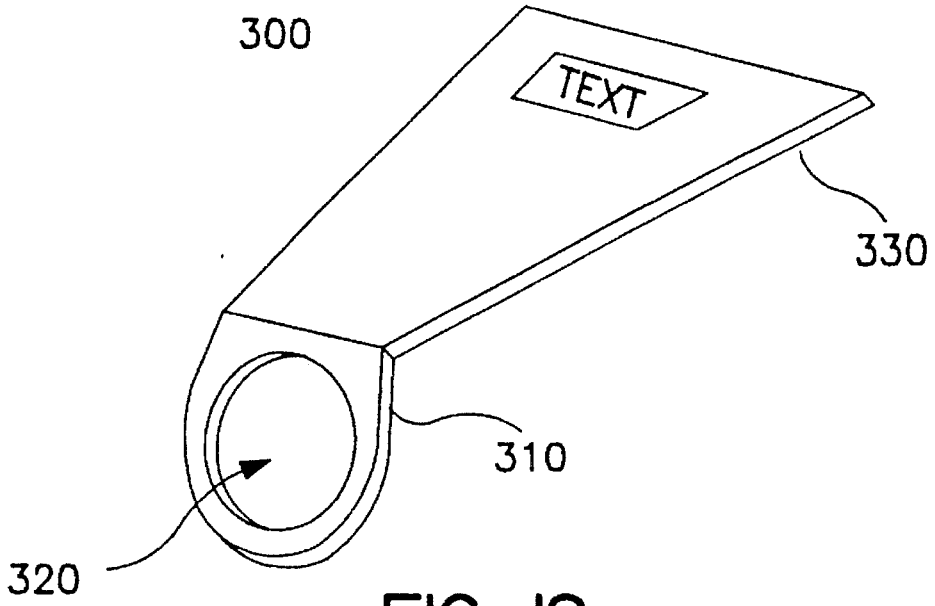
FIG. 12 is an illustration showing a second alternate embodiment of the grip member of the present invention.
Figure 13:
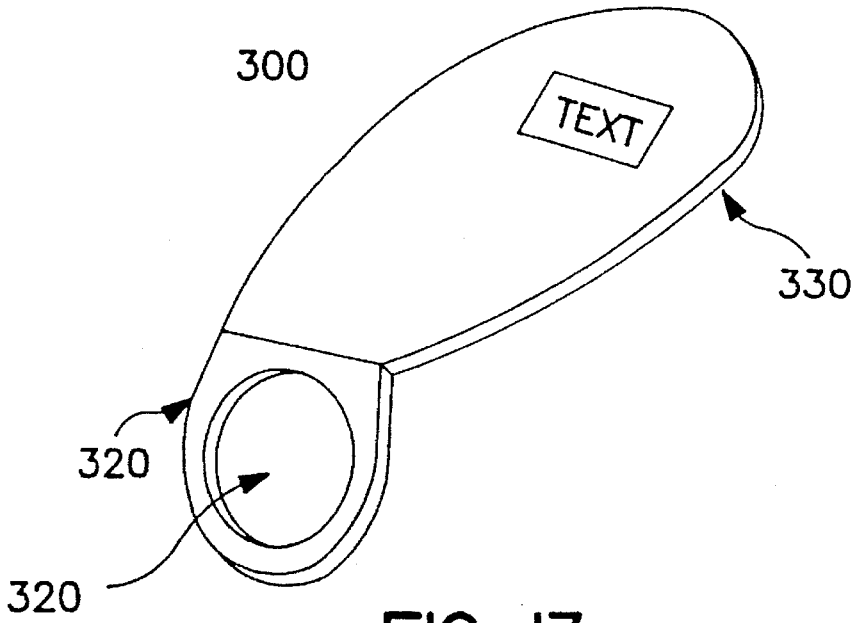
FIG. 13 is an illustration showing a third alternate embodiment of the grip member of the present invention.

Grip member 300 is comprised of a planar collar 310 which is, for example, substantially square or rectangular in shape. As shown in FIGS. 5, 9, 12 and 13, collar 310 may, however, take any number of shapes including a semi-circular or round shape. Collar 310 has an opening 320 formed therein which is substantially annular in shape. In general, the opening 320 is of a shape which closely resembles, or conforms, to a forward profile of the front housing 20 and back housing 30. Thus, where the forward profile of front housing 20 and back housing 30 is, for example, square or rectangular in shape, opening 320 should also be of substantially the same shape. Collar 310 is connected to a pull tab 330. Pull tab 330 is generally of a rectangular shape, but may have any number of shapes which allow for effective manual gripping. Some examples of alternate shapes of pull tab 330 include a trapezoidal shape as shown in FIG. 12 or an oval or spoon-like shape as shown in FIG. 13. The area of pull tab 330 is greater than the area of planar collar 310. It is preferably two to three times greater than the area of planar collar 310 and is sufficient enough to allow easy manual grip contact. The planar collar 310 is connected to planar pull tab 330 so as to form an angle $\Theta$ therebetween which is greater than 90 degrees and less than 180 degrees. In the preferred embodiment, this angle is approximately 120 degrees.

The opening 320 formed in collar 310 has a diameter $D_3$ which is greater than the outer diameter $D_4$ of flange 25, but which is less than the inner diameter $D_2$ of back housing 30. The grip member 300 is connected to the electrical connector 100 by inserting flange 25 of front housing 20 through opening 320 and then into back housing 30. Set screw 50 in back housing 30 is used to put pressure on flange 25 and thereby couple front housing 20 with back housing 30 via friction. Grip member 300 is held in place by collar member 310 which is connected, or sandwiched, between the lip 26 of back housing 30 and the lip 27 of front housing 20.

Collar 310 is thereby clamped between front housing 20 and back housing 30. Set screw 50 is used to exert pressure on flange 25 in such a way that the friction therebetween holds, front housing 20 in place within back housing 30.

Front housing 20 includes a plurality of electrical contacts 60. Electrical contacts 60 are held, or secured, in place within front housing 20 in a proper alignment via an insert assembly 80. Each of the plurality of electrical contacts 60 is connected to an electrical terminal 70. Electrical terminal 70 acts as a physical and electrical interface between and electrical contact 60 and an electrical conductor 41.

Back housing 30 includes an opening 35 for receiving an electrical cable 40. There is also included within back housing 30 a clamp 200 for physically securing cable 40 to electrical connector 100. This clamp 200 is provided in such a way that any strain or stress on electrical cable 40 outside of electrical connector 100 is essentially precluded from being transmitted or passed to the connection between electrical conductors 41 and electrical terminals 70.

Figure 9:
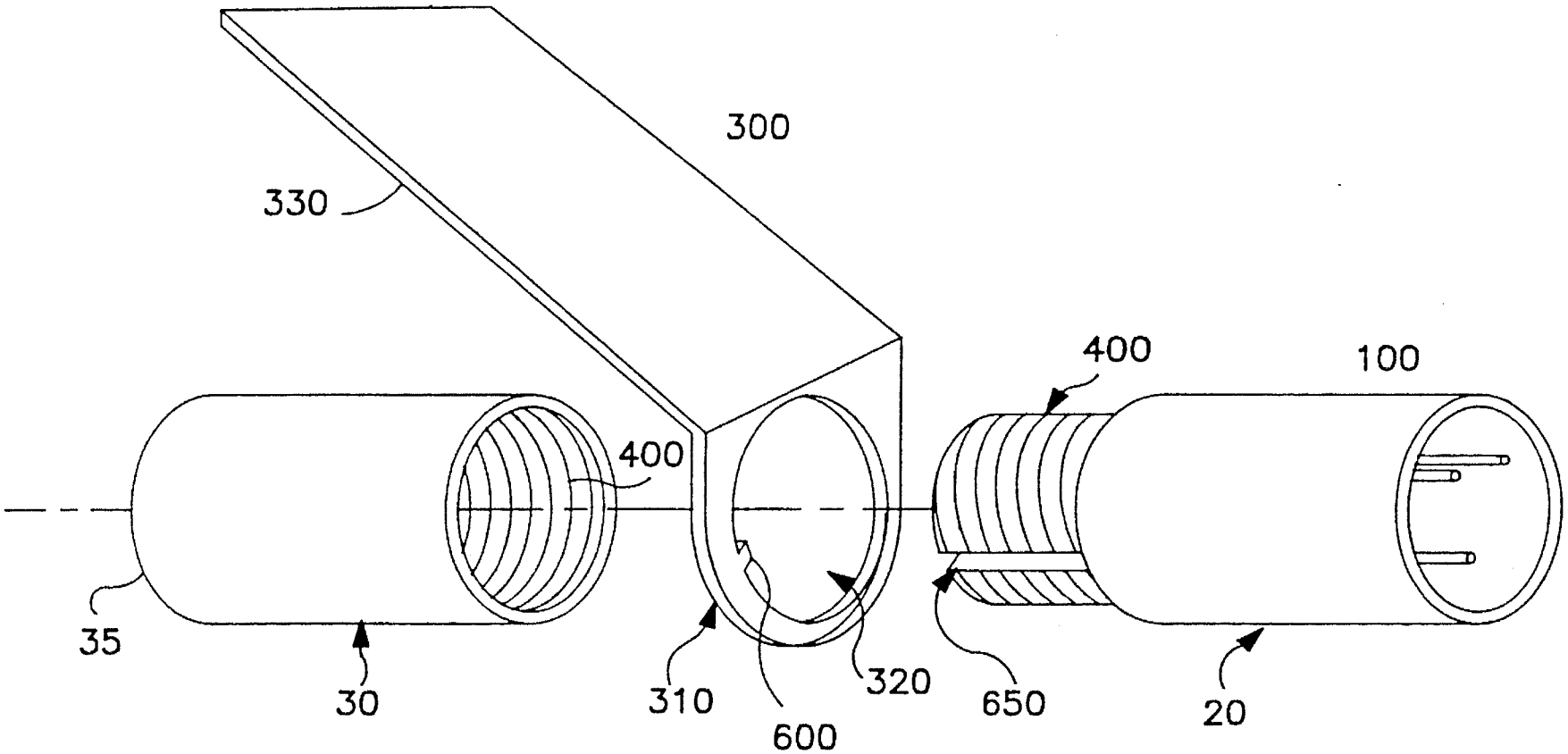
FIG. 9 is a diagram showing a third embodiment of the present invention.

FIG. 9 shows an alternate embodiment of the present invention in which a notch 600 is formed within the inner periphery of opening 320 of grip member 300. This notch 600 is preferably radially aligned with the center of opening 320 and is positioned so as to align and fit within a channel 650 formed on flange 25 of front housing 20 when properly connected, or installed. The interaction of notch 600 with channel 650 acts to preclude grip member 300 from freely rotating about the axis X of connector 100.

Figure 10:
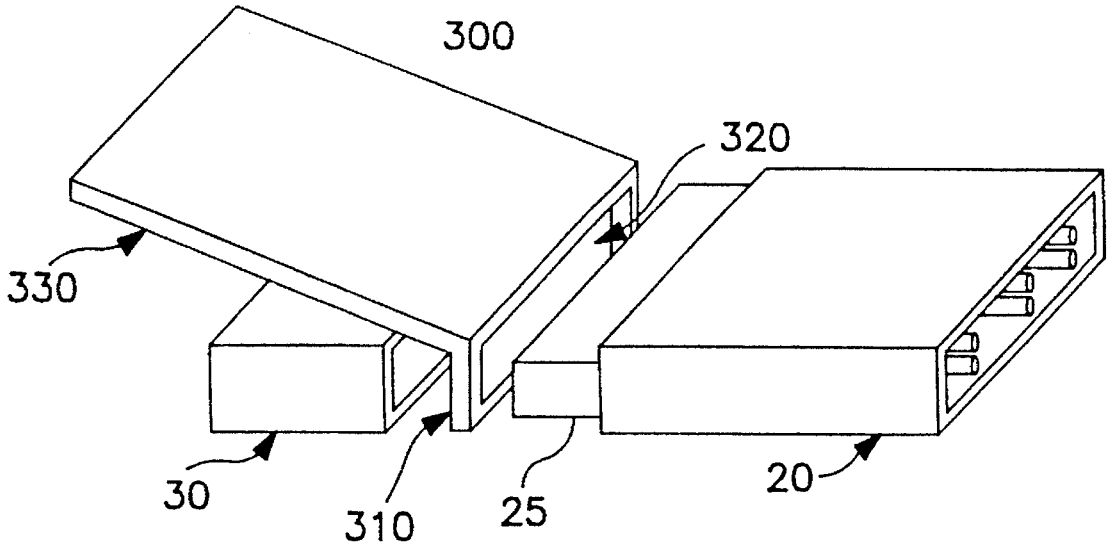
FIG. 10 is a diagram showing a fourth embodiment of the present invention.

FIG. 10 shows an alternate embodiment of the present invention in which front housing 20 and back housing 30 are substantially square or rectangular in shape. Likewise, opening 320 of grip member 300 is generally rectangular in shape so as to accommodate the rectangular forward profile of front housing 20 and flange 25 thereof.

Figure 11:
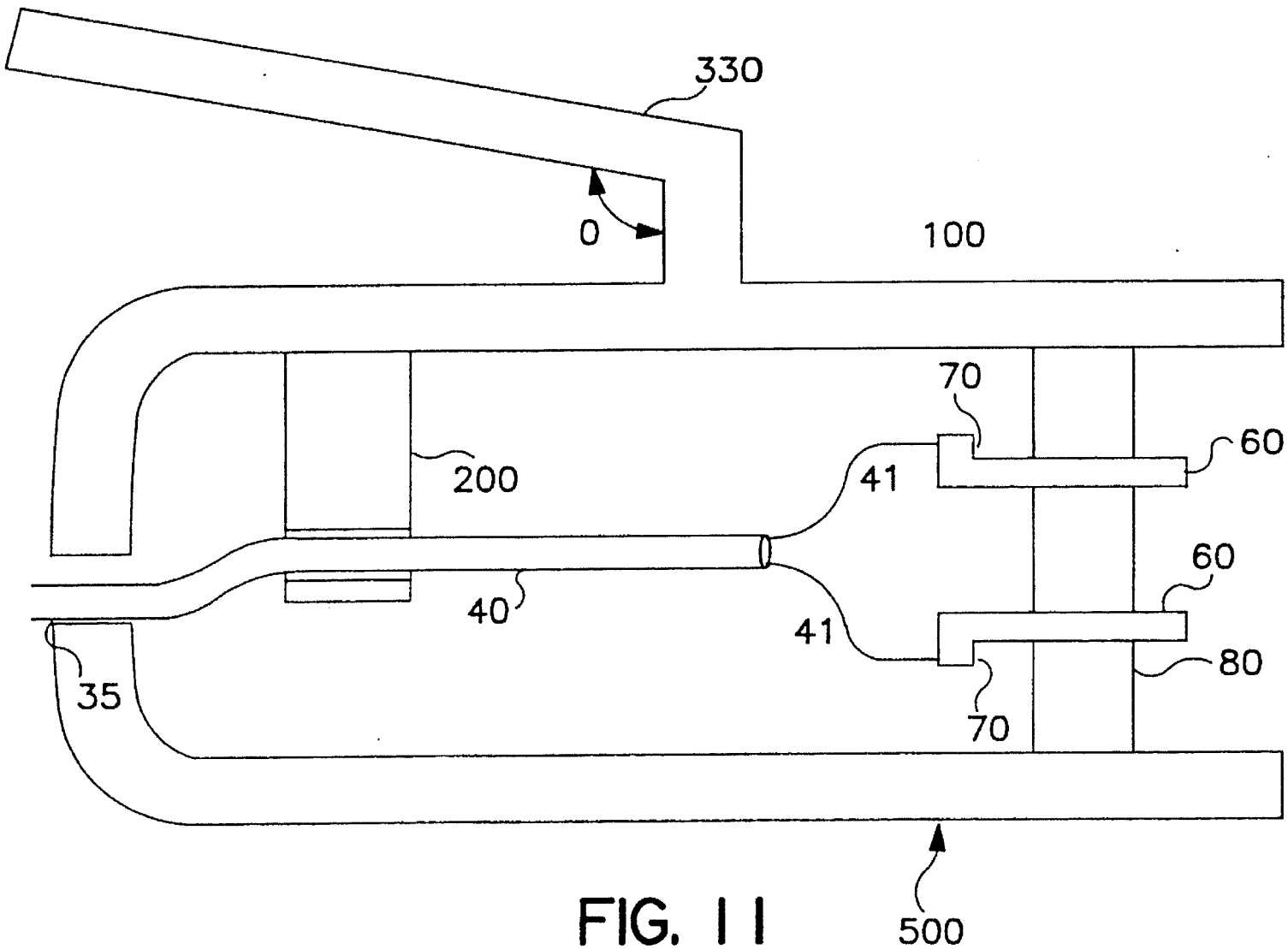
FIG. 11 is an illustration showing an alternate embodiment of the present invention.

FIG. 11 shows another alternate embodiment of the present invention in which electrical connector 100 is comprised of a unitary, or single piece, housing 500 which includes contacts 60, insert assembly 80, clamp 200 and an opening 35. Pull tab 330 is formed as an integral part of unitary housing 500.

Figure 14:
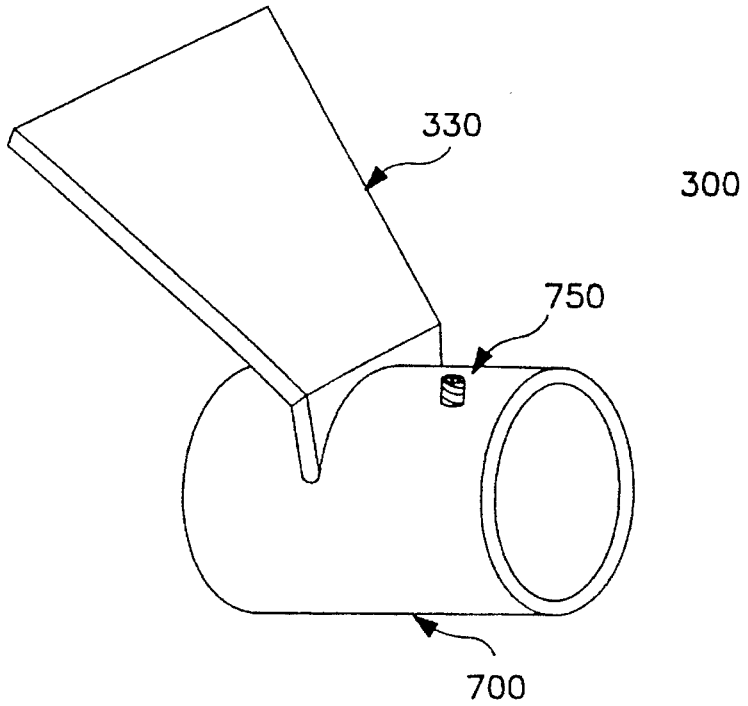
FIG. 14 is an illustration showing a fourth alternate embodiment of the grip member of the present invention.
Figure 15:
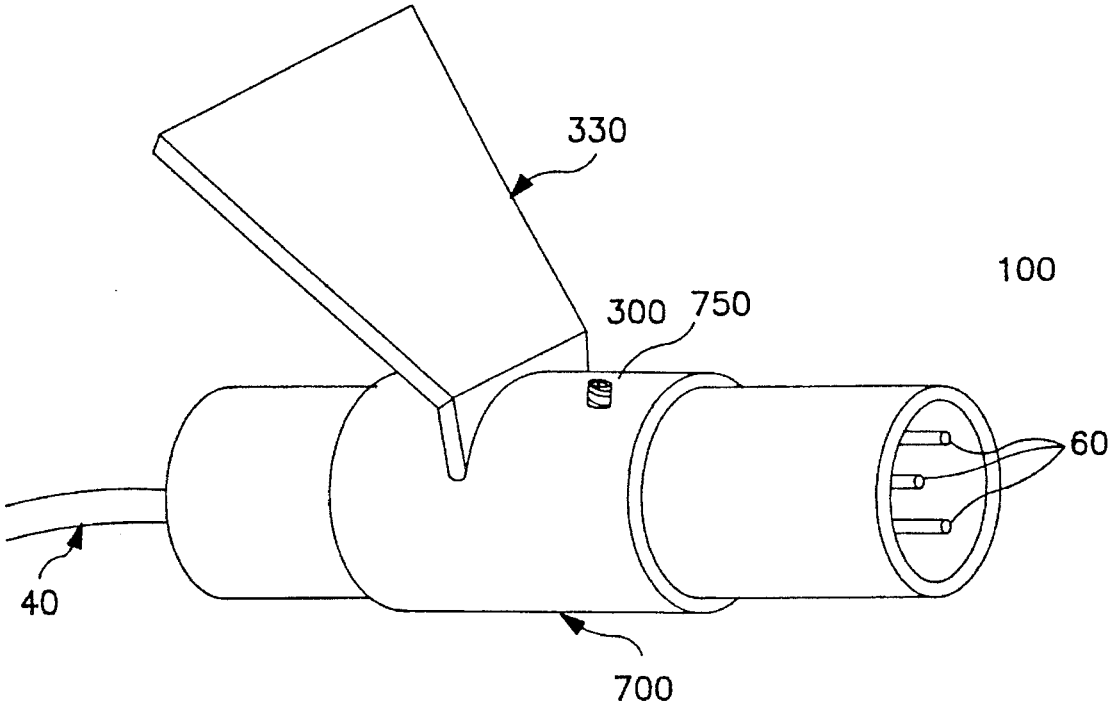
FIG. 15 is an illustration showing a fourth alternate embodiment of the grip member of the present invention.

FIGS. 14 and 15 show a further variation on the present invention in which grip member 300 is comprised of a pull tab 330 which is connected to a sleeve like collar member 700. This collar member 700 is structured so that it will substantially fit over at least a portion of the connector housing. In the preferred embodiment, collar 700 is substantially cylindrical in shape and is secured in place on connector 750 via a set screw 100.

Thus, it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. An electrical connector comprising:

a housing comprising;

a front housing which is detachably coupled to a back housing;

a manual grip member removably attached between said front housing and said back housing comprising:

a substantially planar collar member having an opening formed therein for receiving said housing a substantially planar pull tab having an area which is greater than the area of said planar collar member said pull tab is attached to said collar member so as to form an angle therebetween which is less than 180 degrees but greater than 90 degrees;

said front housing further comprises a plurality of electrical contacts each attached to an electrically conductive terminal an insert assembly for holding said electrical contacts in position within said housing;

said back housing further comprises an opening for receiving an electrical conductor a clamping means for physically interfacing an electrical conductor received through said opening to said back housing; and wherein axial force applied to said pull tab is translated to said housing without stressing said contacts.

2. An electrical connector according to claim 1 wherein said housing is substantially cylindrical in shape.

3. An electrical connector according to claim 1 wherein said housing is substantially cubic in shape.

4. An electrical connector according to claim 3 wherein said opening is substantially rectangular in shape.

5. An electrical connector according to claim 1 wherein said opening is substantially annular in shape.

6. An electrical connector according to claim 1 wherein said planar pull tab is substantially rectangular in shape.

7. An electrical connector comprising:

a substantially cylindrical housing comprised of a front housing and a back housing which are detachably coupled to each other;

a manual grip member having a substantially planar collar member which is connected to a substantially planar pull tab so as to form an angle therebetween which is greater than 90 degrees but less than 180 degrees;

said planar pull tab has an area which is greater than the area of said planar collar;

said collar member comprises a substantially annular opening for receiving and frictionally nonrotatably engaging an outer surface of said cylindrical housing;

said pull tab is substantially rectangular in shape;

said front housing further comprises:

a plurality of electrical contacts, each attached to an electrically conductive terminal;

an insert assembly for holding said plurality of electrical contacts in position within said front housing;

said back housing further comprises:

an opening for receiving an electrical conductor; and a clamping means for physically interfacing an electrical conductor received through said opening with said back housing.

8. An electrical connector comprising:

a substantially cylindrical housing comprising a front housing and a back housing which are detachably coupled to each other;

said front housing comprises:

an inner diameter and an outer diameter;

a plurality of electrical contacts, each connected to an electrically conductive terminal for interfacing with an electrical conductor;

an insert assembly for holding said electrical contacts in proper alignment within said front housing;

a flange having an inner diameter and an outer diameter, formed at one end of said front housing;

said back housing comprises:

an inner diameter and an outer diameter;

an opening for receiving an electrical conductor;

a clamping means for physically interfacing an electrical conductor received through said opening with said back housing;

said inner diameter of said back housing is large enough to receive said outer diameter of said flange in a telescoping manner;

a grip member comprising:

a planar collar member having a substantially annular opening formed therein for receiving said flange;

a planar pull tab connected to said planar collar so as to form an angle therebetween which is greater than 90 degrees and less than 180 degrees;

said planar pull tab has an area which is greater than the area of said planar collar member;

said grip member is connected to said housing via said collar member at a point at which said front housing and said back housing couple; and said annular opening receives said flange in such a way that said collar member is held in place between said front housing and said back housing.

9. An electrical connector comprising:

a substantially cylindrical housing comprising:

a plurality of electrical contacts, each connected to an electrically conductive terminal for interfacing with an electrical conductor;

an insert assembly for holding said electrical contacts in proper alignment within said housing;

an opening for receiving an electrical conductor;

a clamping means for physically interfacing an electrical conductor received through said opening with said housing;

An outer surface electrically and mechanically isolated from said contacts and said conductor;

a manual grip member comprising:

a collar member having of a substantially cylindrical sleeve frictionally fitted to and substantially coaxial with said outer surface; and a planar pull tab, having an area sufficient to permit effective manual gripping, connected to said collar so as to form an angle therebetween which is greater than 90 degrees and less than 180 degrees; and wherein manual application of force to said planar tab is transferred to said housing without jeopardizing the alignment of said contacts.

10. The connector of claim 9 wherein said housing is readily detachable into at least two sections.

* * * * *